US006461118B1

(12) United States Patent
Apostolides et al.

(10) Patent No.: US 6,461,118 B1
(45) Date of Patent: Oct. 8, 2002

(54) OIL PUMP BY-PASS VALVE FOR AN INTERNAL COMBUSTION ENGINE

(75) Inventors: John K. Apostolides, Pittsburgh, PA (US); Ronald Lusco, Claysville, PA (US)

(73) Assignee: RPM Industries, Inc., Washington, PA (US)

( * ) Notice: Subject to any disclaimer, the term of this patent is extended or adjusted under 35 U.S.C. 154(b) by 611 days.

(21) Appl. No.: 08/896,779

(22) Filed: Jul. 18, 1997

(51) Int. Cl.[7] ..... F04B 49/00
(52) U.S. Cl. ..... 417/310; 417/440
(58) Field of Search ..... 417/310, 440

(56) References Cited

U.S. PATENT DOCUMENTS 2,887,058 A * 5/1959 Aspelin et al. ..... 417/310
3,146,720 A * 9/1964 Henry ..... 417/310
4,813,853 A * 3/1989 Otto et al. ..... 417/310
5,759,013 A * 6/1998 Miyazaki et al. ..... 417/310
5,797,732 A * 8/1998 Watanabe et al. ..... 417/310
5,823,750 A * 10/1998 Hoffmann et al. ..... 417/310

* cited by examiner

*Primary Examiner*—Cheryl J. Tyler
(74) *Attorney, Agent, or Firm*—Cohen & Grigsby, P.C.

(57) ABSTRACT

A fluid pump includes a pump housing with a pump cavity in which a first and second gear are positioned for pumping fluid. The first gear is operably connected to a motor for rotation and the second gear is rotatably mounted to a shaft for geared rotation with the first gear. Fluid inlet and outlet ports are located in communication with the pump cavity and adapted respectively for connection with a source of fluid and a discharge means. A bypass valve is positioned between the inlet and outlet ports to selectively permit fluid pumped between the inlet and outlet ports to pass through it when the outlet port is flow restricted. The bypass valve is normally closed to fluid pumped by said first and second gears to flow from said inlet port to said outlet port, but is opened to permit flow to cavitate when not desired to pump.

3 Claims, 1 Drawing Sheet

OIL PUMP BY-PASS VALVE FOR AN INTERNAL COMBUSTION ENGINE

FIELD OF THE INVENTION

The present invention relates to a fluid pump which operates in connection with a starter motor used on an internal combustion engine; and, in particular, to an oil pump which is driven by a starter motor armature drive shaft and which pump includes a bypass valve to provide non-pumping when the starter motor is used in a normal mode.

BACKGROUND OF THE INVENTION

Generally, the fluid pump of the present invention is an improvement over pumps shown U.S. Pat. Nos. 4,553,512, 4,875,551 and 4,502,431. These pumps are used to lubricate the engine during the initial phase of the cranking of the starter motor to turn over an engine. Typically, oil is used as a lubricant to allow engine parts to slide freely and easily with reduced friction. Notwithstanding the use of lubricants having high lubricity there continues to be abrasive wear between metal parts in internal engine components such as the turbocharger, camshaft, crank shaft and rocker assembly, for example. It has been known for some time that the greatest wear on internal engine parts is at the commencement of ignition cranking and engine start-up. During that time, there is insufficient oil pressure in the engine to provide lubrication to the various parts throughout the engine. Accordingly, for these initial moments during start-up, there is metal rubbing against metal without a sufficient lubricant interface so that deterioration in the internal engine components takes place over time.

A particularly important solution to this problem was provided by a prelubrication system disclosed in U.S. Pat. No. 4,502,431 in which oil is introduced in the engine prior to cranking and start-up. The starter motor is utilized as the means for powering the pump to provide prelubrication. In that patent, the starter motor armature shaft is connected to the pump's pumping gears which are rotated to provide the pumping action to the engine to prelubricate prior to the starter motor's solenoid engaging the starter to crank the engine for start-up. One particular embodiment of the starter motor and pump combination is disclosed in U.S. Pat. No. 4,553,512 which is incorporated herein by reference.

The present invention provides a similar pump assembly as that disclosed in U.S. Pat. No. 4,553,512 to provide a selectable means for either prelubricating the engine or pumping the oil out for a quick efficient oil change. This is particularly useful to large fleet operators of vehicles which require frequent oil changes.

Accordingly, it is an object of the present invention to provide a pump mechanism to pump the oil out of an engine sump without having to open the sump's oil plug. It is a further object of the invention to provide a bypass valve which is selectively operable in the prelubrication mode as well as a oil exchange mode either from the engine compartment and/or from a time delayed mechanism.

SUMMARY OF THE INVENTION

The present invention provides a gear-type pump which is integrated to the starter motor of a vehicle. As disclosed in the forementioned prior art, the base portion of the pump generally comprises the back or bearing end or the starter motor and includes a sealed opening through which an extended armature shaft can be mounted to rotate or power the pump gears. A pump housing is integrally formed on the base plate which provides a cavity in which the pump gears are mounted and includes an inlet and outlet port. In addition, the present invention provides an additional port for operation of the bypass mechanism to permit the oil to be pumped and bypassed as an outlet during cavitation. By rendering the bypass valve ineffective, oil can be pumped to the outlet port for either prelubrication or for changing the oil of the vehicle. Other advantages of the present invention will become apparent from a perusal of the following description of a presently preferred embodiment taken in connection with the accompanying drawings.

PRESENTLY PREFERRED EMBODIMENT

Figure 1:
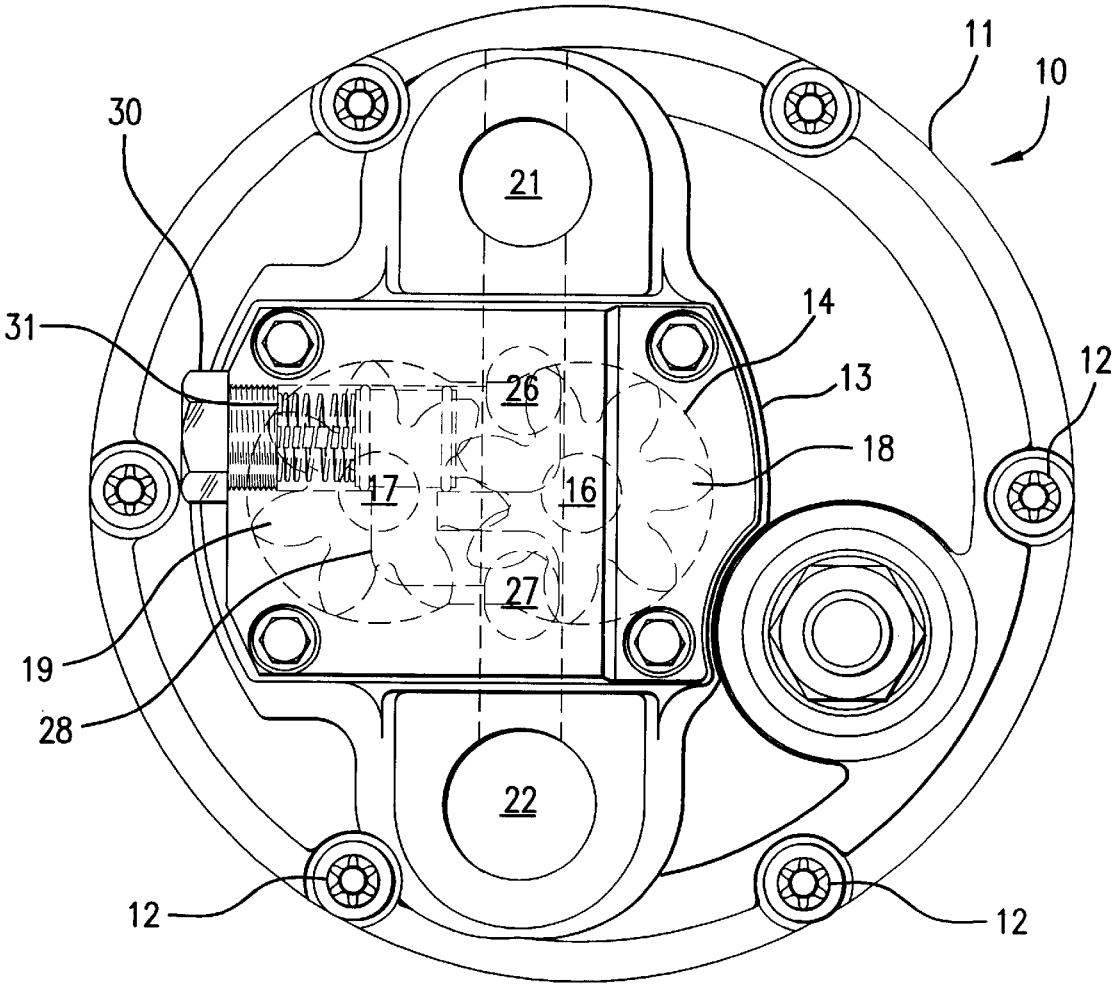
FIG. 1 is a plan view of the pump of the present invention.
Figure 2:
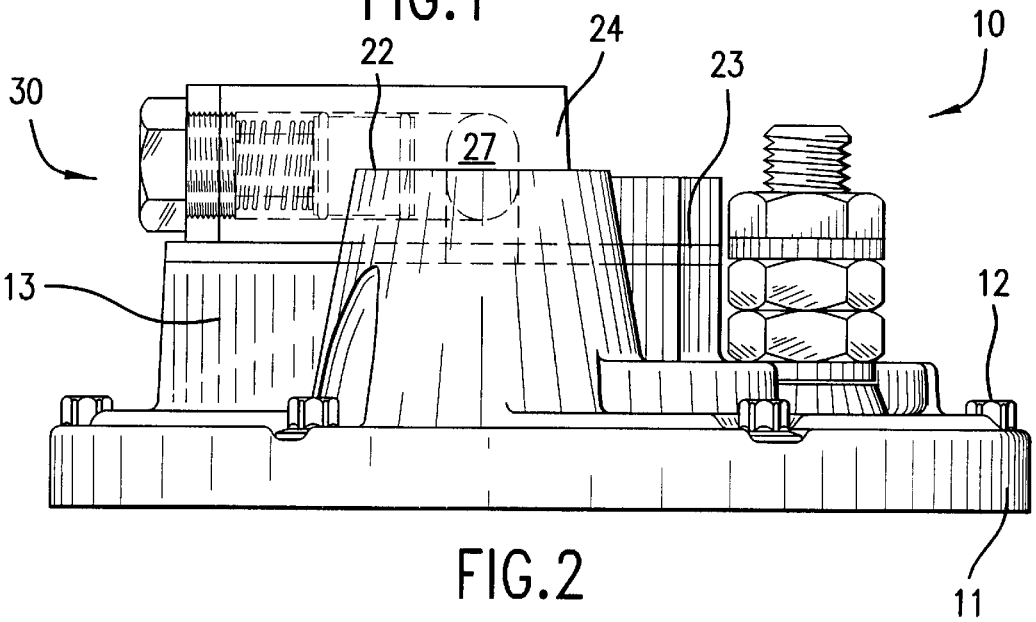
FIG. 2 is a side elevation of the pump shown in FIG. 1.

Referring to FIGS. 1 and 2, pump 10 of the present invention comprises base plate 11 which is adapted to be bolted to the back portion of a starter motor (not shown) by means of a plurality of a circumferentially positioned bolts 12. Integrally formed in base plate 11 is pump housing 13 having an elongated pump cavity 14 and central opening through which armature shaft 16 extends therein. Cavity 14 also includes idler shaft 17 mounted fixably to the other portion of the cavity. Positioned within cavity 14 are pump gears 18 and 19 which are driven by armature shaft 16.

Pump housing 13 also includes inlet port 21 and outlet port 22. These ports are connected to inlet and outlet lines not shown. Sealingly mounted to the pump housing 13 is sealing plate 23 which seals pump cavity 14. In a preferred embodiment sealing plate 23 includes bypass housing 24.

Bypass housing 24 also has a pair of bypass ports 26 and 27 which are juxtaposed for communication between inlet and outlet ports 21 and 22 respectively. A bypass valve 30 is positioned in bypass channel 28 to provide selectable opening and closing of the channel. Bypass valve 30 is preferably a mechanically or hydraulically operated valve that is opened at a predetermined pressure. Alternatively, an electromechanical solenoid valve which is normally biased in the closed position can be used. When the valve opens, oil is permitted to cavitate through channel 28 as the pump rotates during starter motor initiation of conventional crank mode. Valve 30 is shown having spring 31 which biases hydraulic valve 30 closed. Oil pressure or electrical means 32 such as a solenoid opens valve 30 to permit the flow of oil through channel 28.

In the presently preferred embodiment, the bypass valve 30 will remain closed when outlet port 22 is used to permit oil to be pumped therethrough. Outlet port 22 may include an oil line to the engine to provide prelubrication as well known in the prior art or to a discharge receptacle, not shown, for changing the oil in the engine. A switch positioned in the engine compartment can be used to simultaneously activate the turning of the starter motor (without engaging the starter solenoid) so that the closed bypass valve 30 permits the oil to be pumped out of the engine. Various other arrangements can be used to control the bypass valve 30 with oil change and/or prelubrication flow control valves (not shown) positioned at the outlet port or line.

While presently preferred embodiments of the invention have been shown and described in particularity, the invention may be otherwise embodied within the scope of the appended claims.

What is claimed is:

1. A fluid pump for use in a prelubrication system comprising:

a. a pump housing having a pump cavity;

b. a first and second gear positioned in said cavity for pumping fluid, said first gear being operably connected to a motor for rotation and said second gear rotatably mount to a shaft for geared rotation with said first gear;

c. fluid inlet and outlet ports in communication with said cavity and adapted for connection with a source of fluid and a discharge means, respectively; and d. a bypass means positioned between said inlet and outlet ports, said bypass means having a control valve to permit fluid to be pumped between the inlet and outlet ports or to pass through said bypass means, said bypass means being closed to fluid pumped by said first and second gears to flow from said inlet port to said outlet port during a prelubrication or a fluid change, and being opened to permit the oil to cavitate in response to said control valve during operation of the pump when said prelubrication or fluid change is not selected.

2. A fluid pump as set forth in claim 1 wherein said motor is a starter motor of a vehicle.

3. A fluid pump as set forth in claim 2 wherein an armature of said starter motor comprises said means for rotating said first gear.

* * * * *